United States Patent [19]

Dawson et al.

[11] 4,072,034

[45] Feb. 7, 1978

[54] METHOD AND APPARATUS FOR FORMING MATERIAL BY FORCING THROUGH A DIE ORIFICE

[75] Inventors: Graham Robert Dawson, Bewdley; Dennis Hugh Sansome, Sutton Coldfield, both of England

[73] Assignee: National Research Development Corporation, London, England

[21] Appl. No.: 598,876

[22] Filed: July 24, 1975

Related U.S. Application Data

[63] Continuation of Ser. No. 358,391, May 8, 1973, abandoned.

[30] Foreign Application Priority Data

May 9, 1972 United Kingdom ..... 21614/72

[51] Int. Cl.[2] ..... B21C 3/00

[52] U.S. Cl. ..... 72/56; 72/285; 72/467

[58] Field of Search ..... 72/56, 8, 282, 283, 72/285, 467

[56] References Cited

U.S. PATENT DOCUMENTS

| | | | |
|---|---|---|---|
| 3,274,812 | 9/1966 | Evans | 72/285 |
| 3,434,329 | 3/1969 | Goble | 72/467 |
| 3,495,427 | 2/1970 | Balanuth | 72/56 |
| 3,570,297 | 3/1971 | Matthews | 72/276 |
| 3,657,910 | 4/1972 | Isobe | 72/8 |
| 3,774,429 | 11/1973 | Holzer | 72/56 |

FOREIGN PATENT DOCUMENTS

| | | | |
|---|---|---|---|
| 955,943 | 1/1957 | Germany | 72/56 |
| 1,569 | 11/1960 | Japan | 72/56 |

OTHER PUBLICATIONS

"Flow Characteristics Through Conical Conveging Dies" by Avitzur; pp. 410–420; J. Eng. for Industry, vol. 88, Series B, No. 4, Nov. 1966.

"Analysis of Central Bursting Defects in Extrusion and Wire Drawing;" by Avitzur; pp. 79–91, J. Engr. Ind, vol. 90, Series B, No. 1, Feb. 1968.

*Primary Examiner*—C.W. Lanham
*Assistant Examiner*—Gene P. Crosby
*Attorney, Agent, or Firm*—Cushman, Darby & Cushman

[57] ABSTRACT

Method and apparatus for deforming the section of material by forcing it, e.g. punching or drawing it, through a die. The die, die holder and workpiece are vibrated in tune, e.g. acoustically, so that points on the walls of the die orifice oscillate in a direction lying generally radial to the die axis. This causes the die to exert a swaging action upon the material and contribute to the deformation thus reducing the power needs for forcing the workpiece through the die and increasing the maximum deformation obtainable.

7 Claims, 5 Drawing Figures

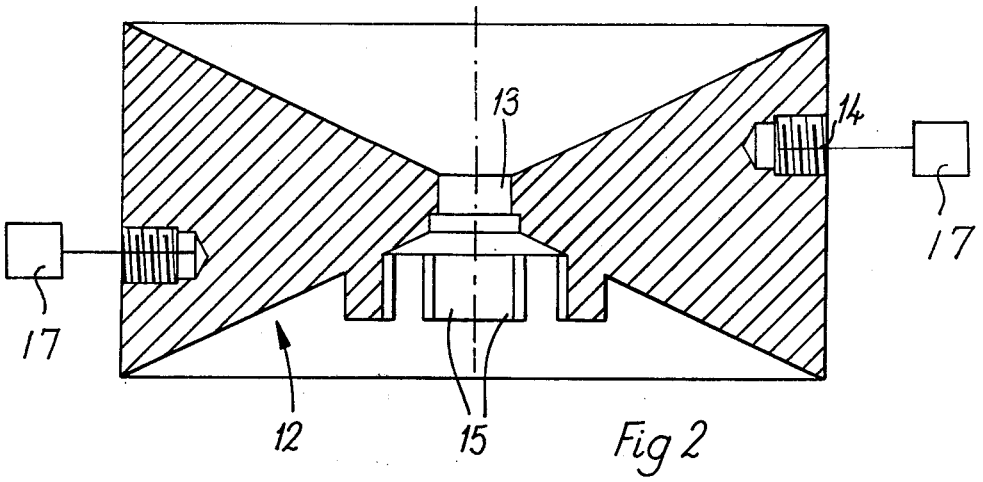
Fig 2
Fig. 3
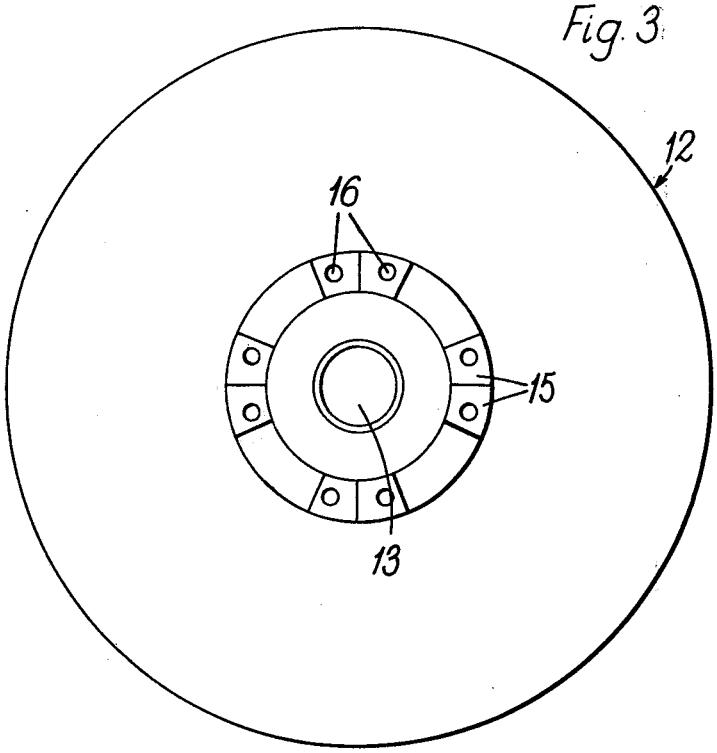

METHOD AND APPARATUS FOR FORMING MATERIAL BY FORCING THROUGH A DIE ORIFICE

This is a continuation, of application Ser. No. 358,391 filed May 8, 1973, now abandoned.

This invention relates to methods and apparatus for forming material by forcing it through a die orifice. In particular, it relates to a method of reducing the thickness of tube, rod or like shapes by drawing them through a female die.

The present invention is based upon the discovery that vibrations of a die may perform positive deformation work upon the workpiece, and thus reduce the work required by the normal drawing or other forming force.

The invention is defined by the claims at the end of this specification, and methods and apparatus according to it will now be described, by way of example, with reference to the accompanying drawings in which:

FIG. 2 is an axial section through the resonator of another apparatus;

FIG. 3 is a rear elevation of the part shown in FIG. 2,

Figure 1:
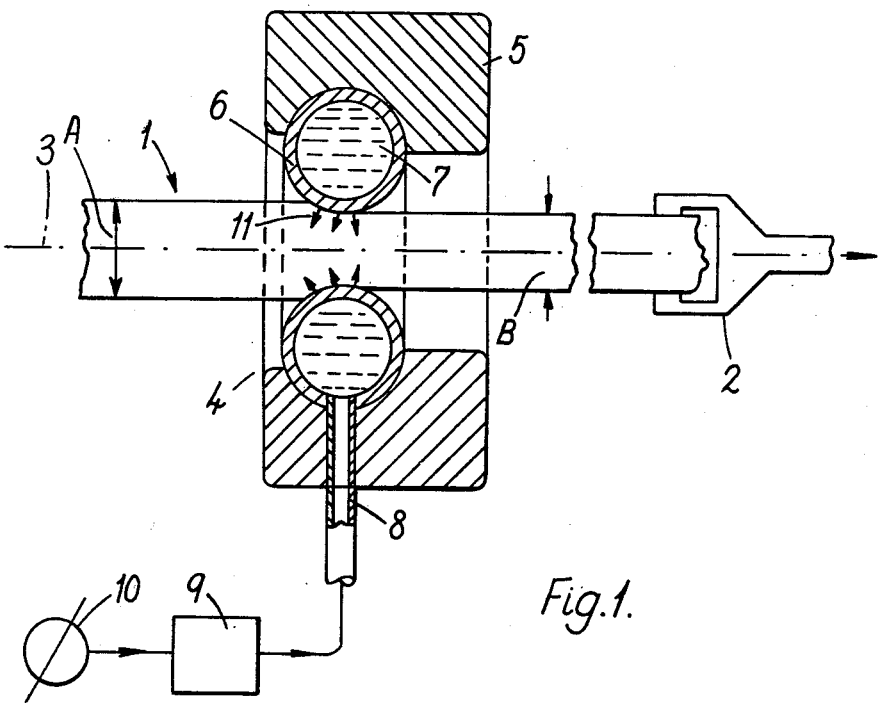
FIG. 1 is a diagrammatic axial section through one drawing apparatus according to the invention.

FIG. 1 shows a workpiece 1, held at one end by jaws 2. A pulling force, acting along the drawing axis 3 in the direction of the arrow, is exerted upon jaws 2 by means not shown but well known in the art. This force draws the workpiece through a die indicated generally at 4. Essentially the die comprises a fixed, rigid outer case or backing member 5, which supports a flexible-walled metal torus 6 filled with hydraulic fluid 7 and connected by way of conduit 8 through backing member 5 to a pulsating device 9 and a source of pressurised hydraulic fluid 10. By applying pulsations through device 9 as workpiece 1 is drawn through die 4, the parts of the wall of torus 6 in contact with the workpiece are constrained to vibrate because the rest of the wall is prevented from moving by the case 5. Pulsating forces are thus imposed upon the workpiece 1, in the directions indicated diagrammatically by arrows 11, so setting up cyclic stresses at the die-to-workpiece interface. These stresses have at least a substantial component in a direction lying normal to the die axis 3: that is to say, they act generally radially relative to that axis. Parameters may be chosen so that the stresses contribute substantially to the work of reducing workpiece 1 from diameter A to diameter B, so making possible reductions in drawing load etc; the choice of such parameters is described in more detail with reference to FIG. 4. Alternatively, if a full conventional drawing load is used, apparatus with the vibrating die of this invention will be able to do extra plastic work upon the workpiece.

FIGS. 2 and 3 show a resonator by which a more conventional ring die may be supported and vibrated acoustically. The resonator 12 is circular when viewed in an axial direction, with a central hole 13 to receive a die not shown. In axial section, as seen in FIG. 2, the resonator tapers outwards from the middle, being shallow at the centre where it defines the hole 13 and wide at the periphery. This tapered construction tends to increase the level of cyclic radial stress in the vicinity of the die since the radial waves are concentrated into a cross-sectional area that diminishes more rapidly than it would if there were no taper. Threaded bores 14 are formed in the periphery, desirably at regular angular intervals, to receive magnetostrictive transducers of known kind shown schematically at 17 in FIG. 2 with their axes normal to the drawing axis 3, to excite resonator 12 so that the die vibrates radially and induces radial stresses in the workpiece. These stresses, as before, contribute to the reduction of the cross-section of the workpiece by what is in effect a swaging action.

Dimensions are preferably chosen so that the elastic vibration in the resonator, die and workpiece sets up a resonance in which high displacement amplitude is achieved at the die/material interface, thus creating high cyclic stresses which do reducing work on the material and thus relieve the drawing loads. In practice this may best be achieved by setting up a stress antinode at the axis, with the adjacent node well removed from the die/workpiece interface. A stress node must exist at the free periphery of the resonator, and this may be the first node.

A carefully designed support is desirable to isolate resonator 12 as well as possible from the drawing machine, so that a minimum of the useful vibrational energy is transmitted to that support and wasted. Lugs 15, mounted on the rear face of resonator 12, have threaded holes 16 so that they may be bolted to the support.

Figure 4:
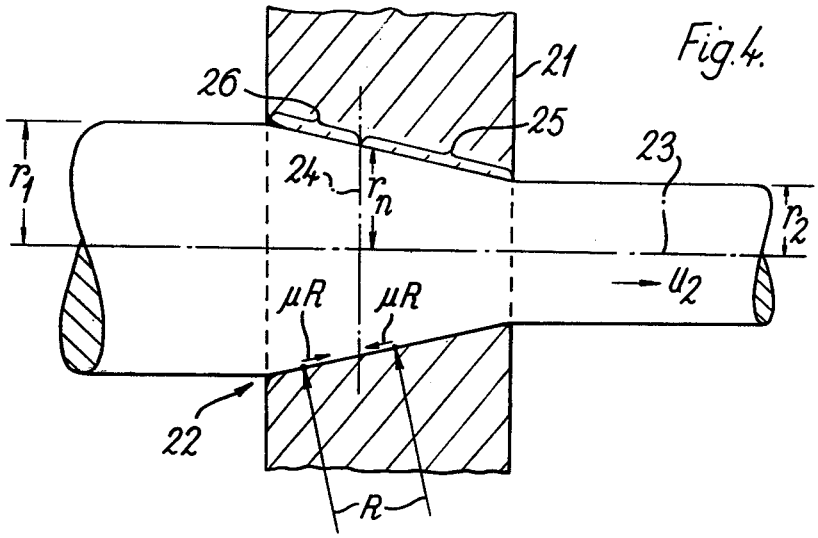
FIG. 4 is an axial section through the die and resonator of another apparatus, indicating some important dimensions and, FIG. 5 is a detail diagrammatic view of a portion of the apparatus of FIG. 4 indicating some important relationships and force vectors.

In experiments leading to the present invention it was appreciated that one of the reasons why vibration of the die contributes to the reduction of the thickness of the work is that it reverses the vector of part of the frictional force between the work and the die. FIG. 4 diagrammatically illustrates this phenomenon, and shows wire 20 of initial radius $r_1$, being reduced to radius $r_2$ by being drawn through a die 21 with a typical part-conical orifice 22. Reference 23 indicates the axis of the wire. Assume die 21 is vibrated as drawing proceeds, in such a manner that each point on the face of orifice 22 oscillates in a direction lying substantially at right angles to axis 23. If jaws exert a constant pulling force on the wire, as is usual, then the periodic contractions of the die will bring about a diminution of the velocity at which the wire enters the die. If the cyclic velocity of the oscillation is sufficiently great, the contraction will actually reverse the wire velocity at the die inlet: during these contractions the wire will cease to enter the die inlet but will instead retreat from it. When this is achieved a neutral plane 24 of radius $r_n$ will be set up within the wire inside the die. At this plane there is zero movement between the surface of the wire and the wall of the die orifice. Downstream of this plane the wire surface is moving in the downstream direction relative to the orifice wall in the usual way, but upstream of this plane the relative movement at each point of contact between wire surface and orifice wall will be reversed. Thus in FIG. 4, where R is the force of normal reaction between wire and die, and $\mu$ is the coefficient of friction, the resulting dynamic frictional force $\mu R$ imposed by the die on the wire will be zero at plane 24, and will be directed in an upstream direction (as in zone 25) as usual at all points downstream of plane 24. Upstream of this plane, however, the force $\mu R$ will act in the downstream direction and so aid the drawing operation as in zone 26. The location of plane 24 may be determined by applying the continuity equation:

flow rate in = flow rate out + rate of change in volume.

This yields the equation:

$$\left(\frac{r_n}{r_2}\right)^2 = \frac{2\pi fA \cdot \text{Cot}\alpha + U_2}{2\pi fA \cdot \text{Cot}\alpha}$$

where $U_2$ is the velocity of the wire leaving the die, A is the amplitude of the vibration measured at right angles to axis 23, $f$ is the frequency of that vibration and $\alpha$ is the die angle. The simplified expression:

$$2\pi fA \cdot \text{Cot}\alpha \geqq \frac{U_2(1 - r)}{r}$$

where $r$ is the reduction caused by passage through the die, indicates the condition that must be satisfied, over some part of the die/work interface, if any reversal of the friction vector, and thus any relief of the drawing force as supplied by the jaws, is to be achieved. It will thus be apparent that low drawing velocities, high reductions, high amplitude and/or frequency of die vibration and low die angle all tend to satisfy the simplified expression above. It will in particular be apparent that if other parameters are fixed for a chosen apparatus and process, there is a minimum die velocity (i.e. $2\pi f$A), and a minimum reduction in area below which there will be no reversal of the friction vector.

Figure 5:
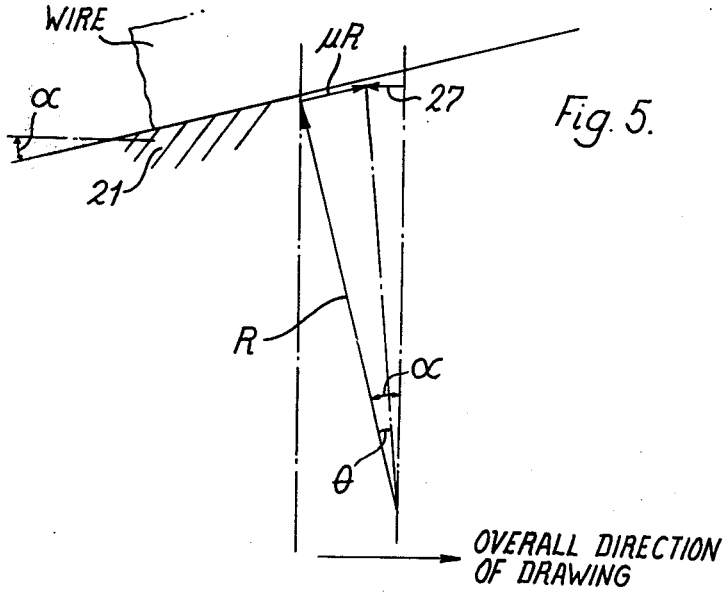

FIG. 5 indicates a relationship between the die angle $\alpha$ and the angle of friction $\theta$. In this, vector 27 represents the axial component of the resultant force imposed by the die on the wire. It will be apparent that when $\theta > \alpha$, vector 27 will act in the direction of drawing and therefore will assist in forcing the remainder of the workpiece through the die.

The invention has hitherto been described with relation to the forming of a solid workpiece by reducing its external dimension.

However it applies also to other apparatus and operations, for instance operations in which the outer dimension of a hollow article (e.g. a box or tube section) is reduced with or without the use of an internal plug, or in which a hollow section is expanded by drawing it over a plug, the plug being so shaped e.g. conical — and vibrated so as to exert an intermittent and radially outward force upon the section in contact with it.

We claim:

1. Apparatus for substantially deforming a section of a workpiece, said apparatus comprising:

a. a circumferentially continuous die with an orifice therein defining a deforming axis;

b. power means for forcing the workpiece through said die orifice to effect said deformation;

c. a die holding member assembled with said die;

d. means for supporting said die holding member, said supporting means being disposed with substantially symmetry relative to said deforming axis when viewed in projection onto a plane normal to said axis, so that said axis is held stationary, and e. vibrator means tuned to the assembly of said workpiece, die and die holding member for vibrating said assembly to cause said assembly as a whole to resonate in a mode in which the die expands and contracts radially, so that a swaging action is effected upon the workpiece to perform positive deformation work upon it, and thereby reduce the proportion of the total of said deformation that said power means are required to effect, said vibrator means comprising at least one vibrator device assembled with said die holding member, said vibrator means being disposed with substantial symmetry relative to said deforming axis when viewed in projection onto a plane lying normal to said axis.

2. Apparatus as recited in claim 1 wherein the interface between said die and said workpiece comprises a substantial part corresponding to the outline of a cone, said cone being coaxial with said deforming axis and being convergent in the direction of movement of the workpiece down that axis, and wherein the angle of friction between said workpiece and said die exceeds half the vertex angle of said cone.

3. Apparatus as recited in claim 1 wherein said die holder comprises a disc with a central hole therein to receive said die and incorporating transducers to set up resonant vibrations in said workpiece, die, and disc, and wherein said disc is axially symmetrical and is of tapering shape, being axially deeper at the periphery thereof than adjacent said central hole.

4. Apparatus as recited in claim 1 wherein said vibrator means comprises a plurality of vibrators symmetrically disposed around said die.

5. A method for substantially deforming a section of a workpiece, said method comprising the steps of:

a. by using power means, forcing a workpiece through a die orifice of a circumferentially continuous die, assembled with a die holding member, said assembly being supported by means disposed with substantial symmetry relative to the axis of said die when viewed in projection onto a plane normal to that axis, whereby that axis is held stationary, and b. vibrating the assembly of said die, workpiece and die holding member by means of a vibrator device disposed with substantial symmetry relative to said die axis when viewed in projection onto a plane normal to that axis, and tuned to said assembly to cause said assembly as a whole to resonate in a mode in which the die orifice expands and contracts radially to exert a swaging action upon the workpiece and perform positive deformation work upon it, so that the proportion of the totality of said deformation that said power means are required to effect is reduced.

6. A method as recited in claim 5 wherein the expression $2\pi f$A Cot$\alpha \geqq U_2(1-r)/r$ is fulfilled, where $r$ is the reduction in section area of the workpiece in passing through the die, $U_2$ is the axial speed at which the reduced workpiece leaves the die, $\alpha$ is the die angle, and A and $f$ are respectively the amplitude and frequency of the vibration of the die, measured in a plane normal to the die axis.

7. A method according to claim 5 in which the angle of friction between the die and the workpiece is at least about equal to the die angle.

* * * * *